US008646235B2

(12) United States Patent
Hilburn, Jr.

(10) Patent No.: US 8,646,235 B2
(45) **Date of Patent: *Feb. 11, 2014**

(54) FIRE RESISTIVE JOINT COVER SYSTEM

(75) Inventor: Johnnie Daniel Hilburn, Jr., Wichita, KS (US)

(73) Assignee: Balco, Inc., Wichita, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/281,030

(22) Filed: Oct. 25, 2011

(65) Prior Publication Data

US 2012/0272597 A1 Nov. 1, 2012

Related U.S. Application Data

(63) Continuation-in-part of application No. 11/625,185, filed on Jan. 19, 2007, now Pat. No. 7,856,781, and a continuation-in-part of application No. 12/971,823, filed on Dec. 17, 2010, now Pat. No. 8,079,190.

(51) Int. Cl.
*E04B 1/62* (2006.01)

(52) U.S. Cl.
USPC ..... 52/394; 52/393; 52/396.01; 52/396.03; 52/232

(58) Field of Classification Search
USPC ..... 52/317, 393, 394, 396.01, 396.03, 402, 52/232, 396.04
See application file for complete search history.

(56) References Cited

U.S. PATENT DOCUMENTS

| | | | | |
|---|---|---|---|---|
| 3,363,383 | A | | 1/1968 | La Barge |
| 3,371,456 | A | | 3/1968 | Balzer |
| 3,750,359 | A | | 8/1973 | Balzer |
| 4,566,242 | A | | 1/1986 | Dunsworth |
| 4,866,898 | A | * | 9/1989 | LaRoche et al. ..... 52/396.01 |
| 5,137,937 | A | * | 8/1992 | Huggard et al. ..... 523/179 |
| 5,326,609 | A | * | 7/1994 | Gohlke ..... 428/76 |
| 5,830,319 | A | * | 11/1998 | Landin ..... 162/159 |
| 5,875,598 | A | | 3/1999 | Batten |
| 5,974,750 | A | * | 11/1999 | Landin et al. ..... 52/396.01 |
| 6,112,488 | A | * | 9/2000 | Olson et al. ..... 52/393 |
| 6,128,874 | A | * | 10/2000 | Olson et al. ..... 52/232 |
| 6,131,352 | A | * | 10/2000 | Barnes et al. ..... 52/396.01 |
| 6,207,085 | B1 | | 3/2001 | Ackerman |
| 6,253,514 | B1 | * | 7/2001 | Jobe et al. ..... 52/471 |
| 6,996,944 | B2 | * | 2/2006 | Shaw ..... 52/232 |
| 7,856,781 | B2 | | 12/2010 | Hilburn, Jr. |
| 8,079,190 | B2 | | 12/2011 | Hilburn, Jr. |

OTHER PUBLICATIONS

Metacaulk; Joint Systems; System No. FF-D-0053; Assembly Rating—2 hour, Nominal Joint Width—1 Inch, Class II or III Movement Capabilities—25% Compression or Extension; www.rectorseal.com; www.metacaulk.com.

(Continued)

*Primary Examiner* — Robert J Canfield
*Assistant Examiner* — Matthew Gitlin
(74) *Attorney, Agent, or Firm* — Hovey Williams LLP

(57) ABSTRACT

A fire resistive joint cover system operable to span a gap between two surfaces. The system generally may include first and second base members, a covering member, and an intumescent sheet. Each base member is operable to couple with one of the surfaces and the covering member is operable to couple with the base members to at least partially span the gap. In some embodiments, the covering member may be configured as a floating covering member and/or as a flexible elastomer seal.

19 Claims, 7 Drawing Sheets

(56) References Cited

OTHER PUBLICATIONS

Metacaulk; Joint Systems; System No. WW-D-0054; Assembly Rating—4 hours; Joint Width—1 Inch, Class II or III Movement Capabilities—25% Compression and Extension; www.rectorseal.com; www.metacaulk.com.

Metacaulk; Joint Systems; System No. WW-D-0056; Assembly Rating—2 hours; Joint Width—1 Inch Max; Class II and III Movement Capabilities—25% Compression and Extension; www.rectorseal.com; www.metacaulk.com.

Metacaulk; Joint Systems; System No. WW-S-0037; Assembly Rating—2 hours; Joint Width—1 Inch Max; wwww.rectorseal.com; www.metacaulk.com.

Product Data Sheet; Metacaulk BlazeSeal; Fire Door Strip; Oct. 2007.

UniFrax Product Information Sheet; FyreWrap XFP; Expanding Paper; 2002.

* cited by examiner

FIRE RESISTIVE JOINT COVER SYSTEM

CROSS REFERENCE TO RELATED APPLICATION

The present application is a continuation patent application and claims priority benefit, with regard to all common subject matter, of earlier-filed U.S. continuation patent application titled "FIRE RESISTIVE JOINT COVER SYSTEM", Ser. No. 12/971,823, filed Dec. 17, 2010, which is a continuation patent application and claims priority benefit, with regard to all common subject matter, of earlier-filed U.S. nonprovisional patent application titled "FIRE RESISTIVE JOINT COVER SYSTEM", Ser. No. 11/625,185, filed Jan. 19, 2007, now issued as U.S. Pat. No. 7,856,781, issued Dec. 28, 2010. The identified earlier-filed applications are hereby incorporated by reference in their entirety into the present application.

BACKGROUND

1. Field

Embodiments of the present invention relate to fire resistive joint cover systems. More particularly, various embodiments of the invention provide a fire resistive joint cover system including at least one fire-resistive sheet.

2. Description of the Related Art

It is often desirable to position fire resistive materials such as intumescent sheets within joints formed between roof, wall, floor, and ceiling members. Unfortunately, prior art fire resistive joint cover systems often fail to adequately provide for joint movement or properly position fire resistive materials within joints.

SUMMARY

Embodiments of the present invention solve the above-described problems and provide a distinct advance in the art of fire resistive joint cover systems. More particularly, various embodiments of the invention provide a fire resistive joint cover system including at least one fire-resistive sheet that adequately provides for joint movement.

For example, various embodiments of the present invention provide a joint cover system operable to span a gap between two surfaces. The system generally includes first and second base members, a covering member, and an intumescent sheet. Each base member is operable to couple with one of the surfaces and the covering member is operable to couple with the base members to at least partially span the gap. In some embodiments, the covering member may be configured as a floating covering member and/or as a flexible elastomer seal.

The intumescent sheet may attach to the surfaces and/or the base members. In some embodiments, the intumescent sheet may be coupled with a support structure that is operable to couple with the surfaces and/or base members. The support structure may have opposed flanges operable to couple with the surfaces and/or base members and be larger in at least one dimension than the intumescent sheet.

Other aspects and advantages of the present invention will be apparent from the following detailed description of the preferred embodiments and the accompanying drawing figures.

BRIEF DESCRIPTION OF THE DRAWING FIGURES

Various embodiments of the present invention are described in detail below with reference to the attached drawing figures, wherein.

Figure 1:
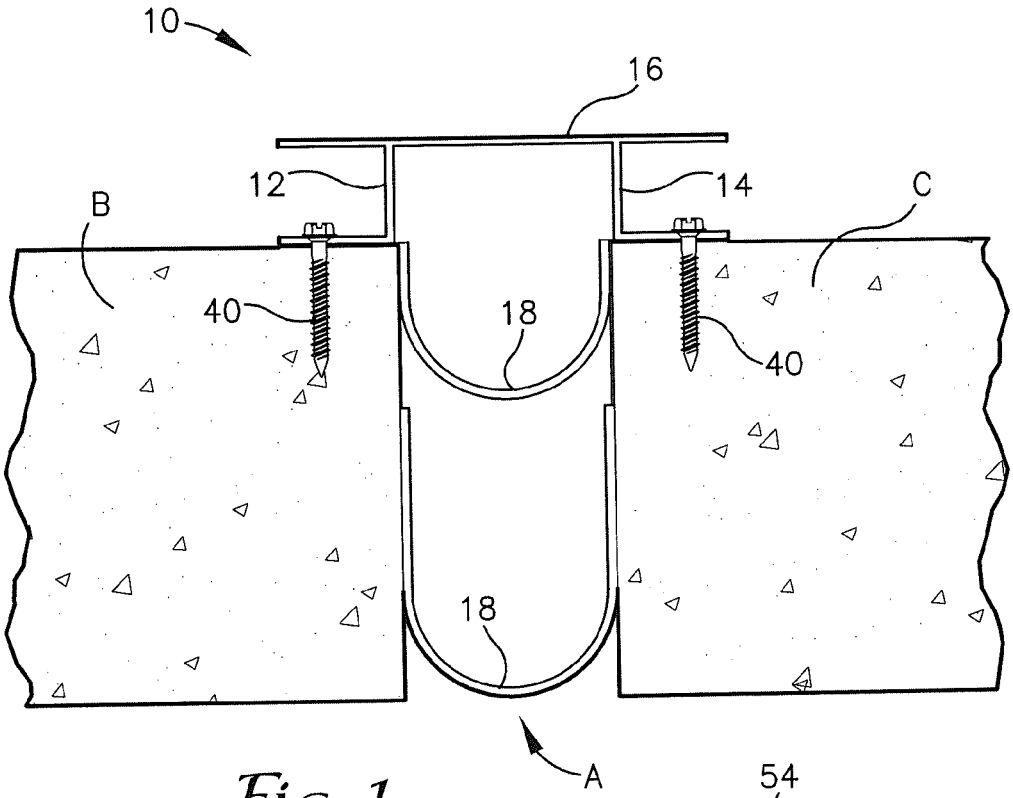
FIG. 1 is a perspective view of a joint cover system configured in accordance with various embodiments of the present invention.
Figure 2:
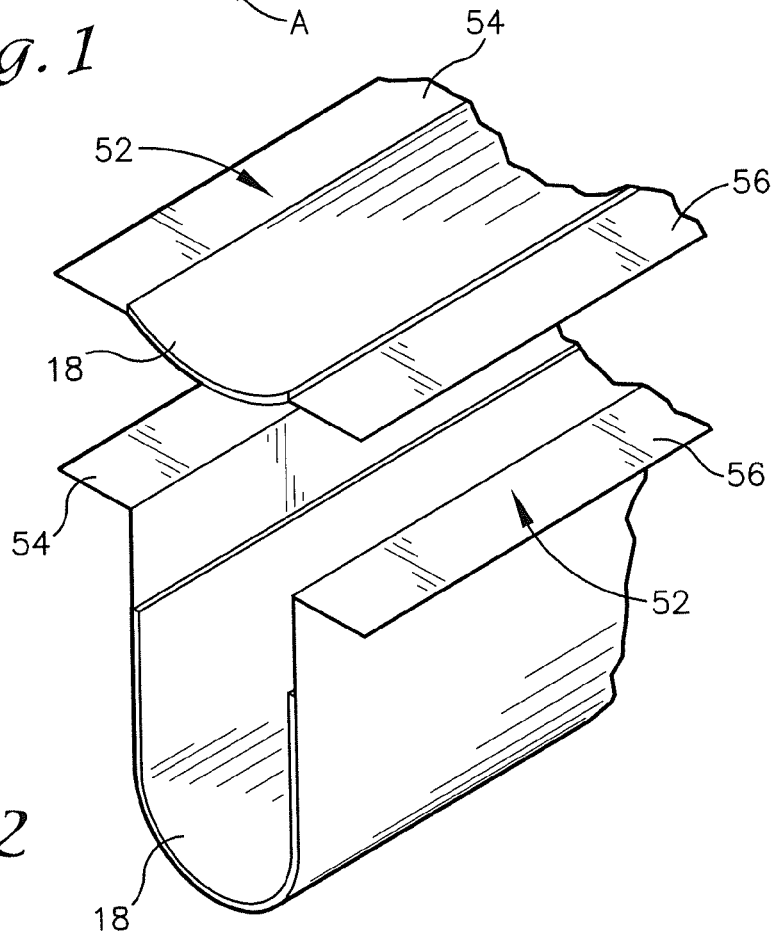
FIG. 2 is a perspective view of intumescent sheets and support structures operable to be utilized by the system of FIG. 1.
Figure 3:
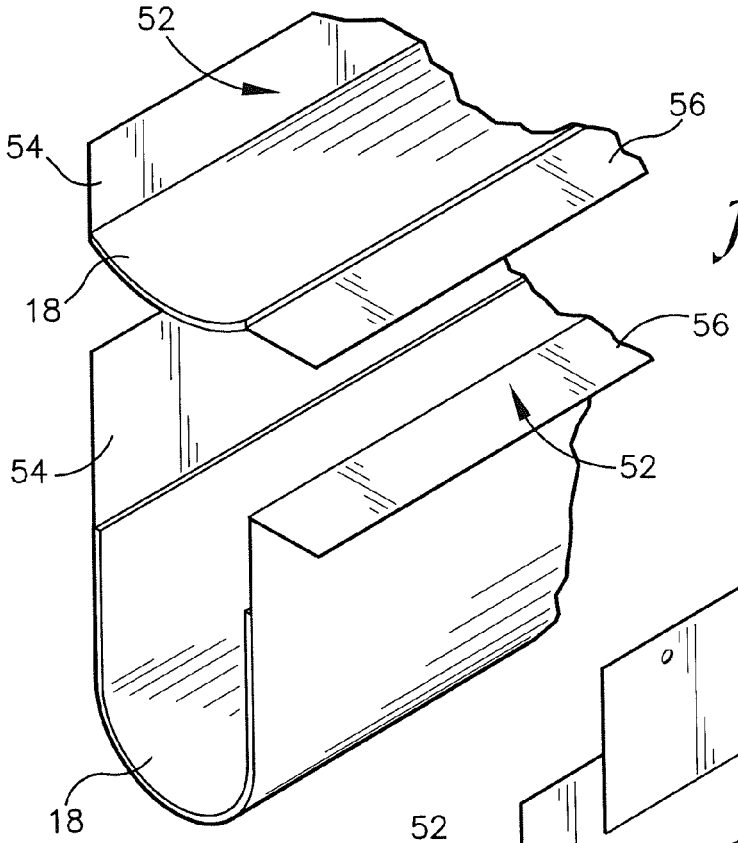
FIG. 3 is a perspective view of various other intumescent sheets and support structures operable to be utilized by the system of FIG. 1.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of various embodiments of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Referring to FIGS. 1-14, embodiments of the present invention provide a fire resistive joint cover system 10 operable to span a gap A between two surfaces B, C. The system 10 may be employed to span gaps between surfaces including roof, wall, floor, and ceiling members or any other gaps, joints, or spaces formed between building and construction elements. Each surface B, C may include a plurality of sides, such as top, right, left, and bottom sides.

The system 10 broadly includes a first base member 12 operable to couple with one of the surfaces B or C, a second base member 14 operable to couple with the other surface B or C, a covering member 16 operable to couple with the base members 12, 14 to span the gap A, and a fire-resistive sheet such as an intumescent sheet 18. However, in some embodiments, the system 10 may lack the base members 12, 14 such that the covering member 16 may be configured to directly couple with one of the surfaces B, C.

Each base member 12, 14 may couple with any portion of one of the surfaces B, C. For example, the base members 12, 14 may couple with the top of surfaces B, C such as when the system 10 is employed to span roof or floor members. One of the base members 12 may couple with the top of one of the surfaces B, C and the other base member 14 may couple with the side of one of the surfaces B, C, such as where the system 10 is employed to span gaps between or along walls. Similarly, both of the base members 12, 14 may couple with the bottom of the surfaces B, C such as where the system 10 is employed to span a joint formed in a ceiling.

Figure 6:
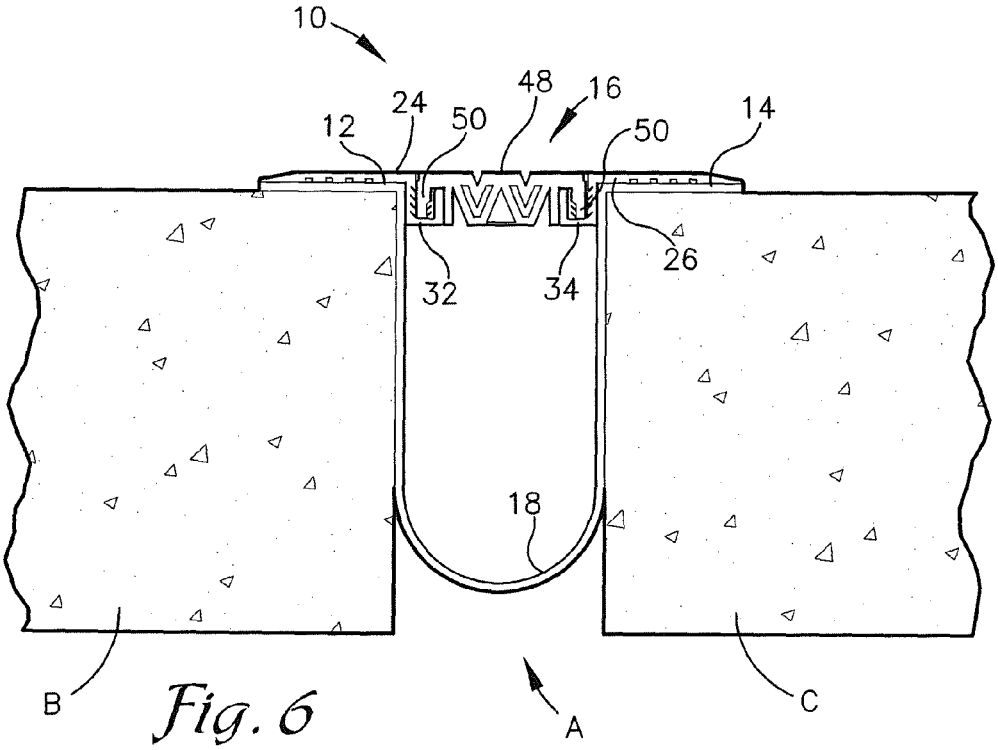
FIG. 6 is a side view of a joint cover system configured in accordance with various other embodiments of the present invention.
Figure 7:
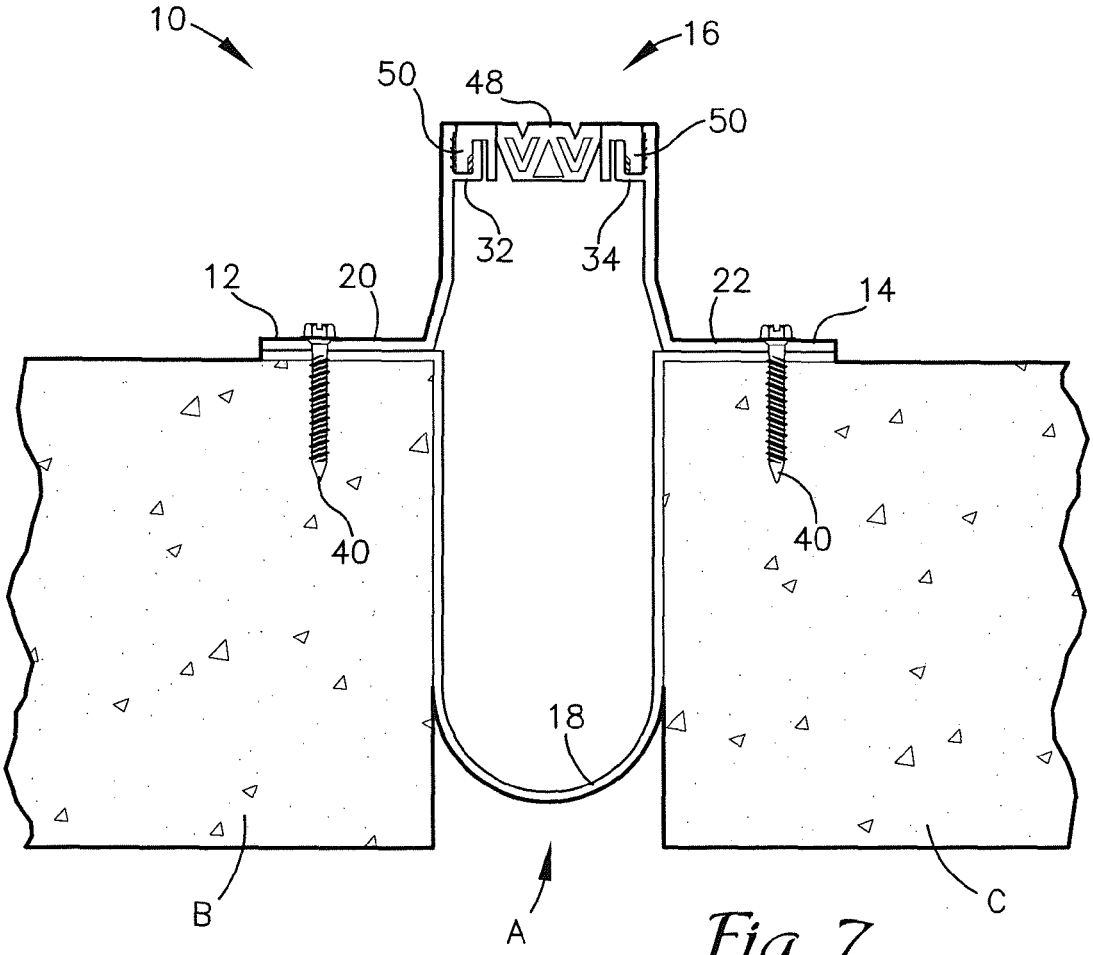
FIG. 7 is a side view of a joint cover system configured in accordance with various other embodiments of the present invention.
Figure 8:
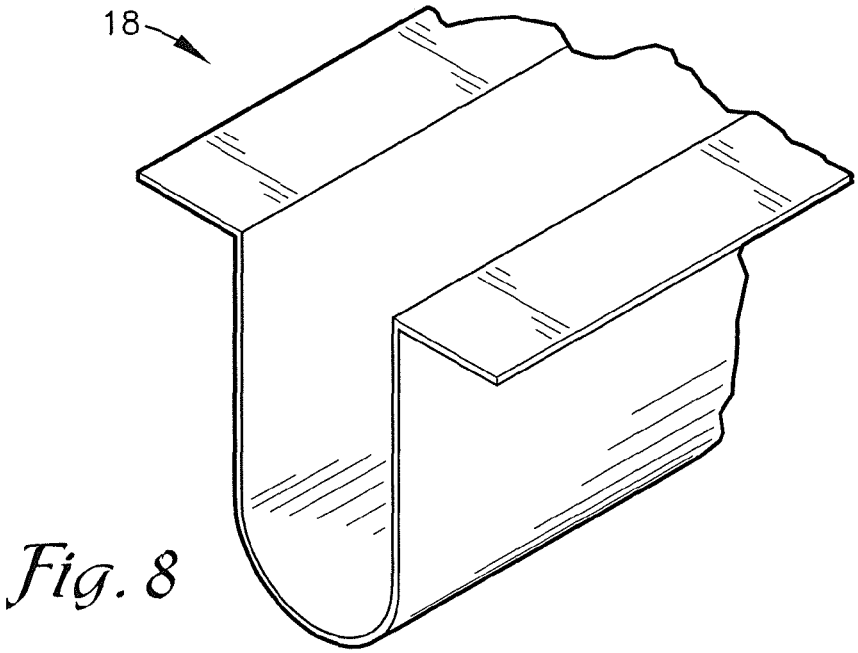
FIG. 8 is a perspective view of an intumescent sheet operable to be employed by various embodiments of the present invention.
Figure 9:
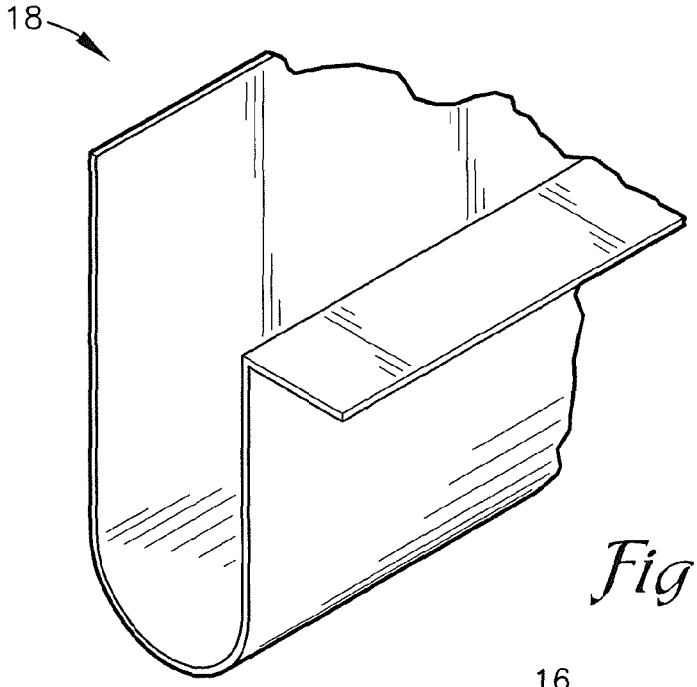
FIG. 9 is a perspective view of another intumescent sheet operable to be employed by various embodiments of the present invention.

Further, the base members 12, 14 may be configured to elevate above the surfaces B, C to enable the covering member 16 to be positioned substantially above the gap A formed between the two surfaces B, C, as is shown in FIGS. 1 and 7. The base members 12, 14 may also be configured to lie generally flat against the surfaces B, C, as is shown in FIG. 6.

Figure 5:
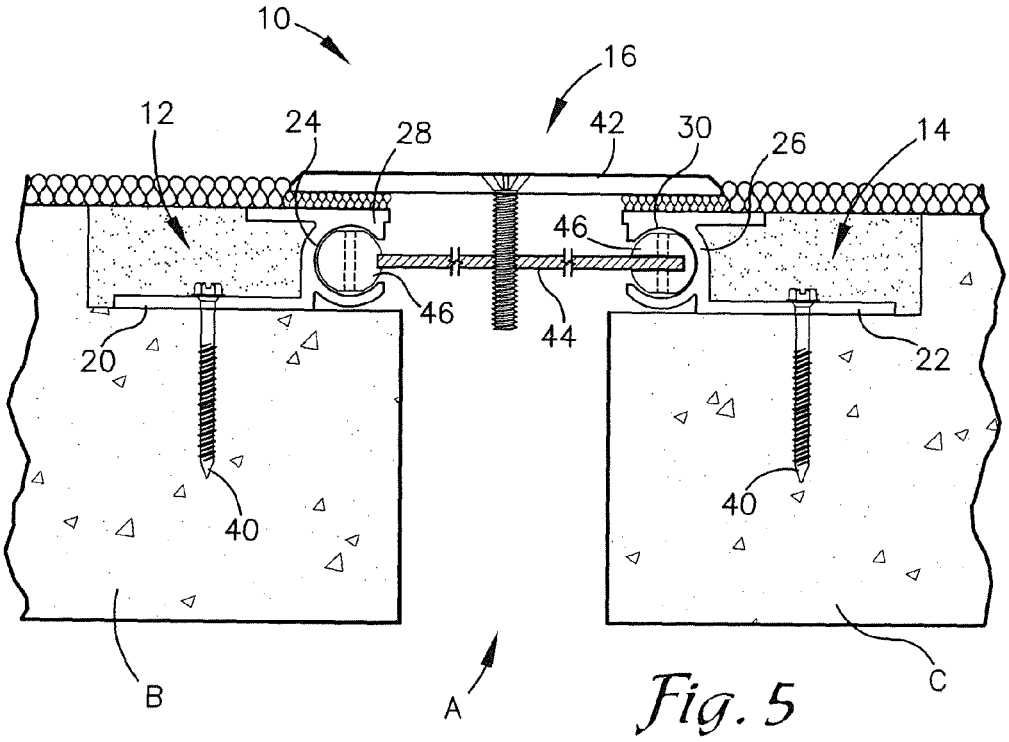
FIG. 5 is a side view of a joint cover system configured in accordance with various other embodiments of the present invention.

The base members 12, 14 may present any configuration operable to couple with the covering member 16 and at least one of the surfaces B, C. In some embodiments, as shown in FIG. 5, the first base member 12 may include a first anchoring flange 20 and the second base member 14 may include a second anchoring flange 22, with the first anchoring flange 20 being operable to couple with one of the surfaces B or C and the second anchoring flange 22 being operable to couple with the other surface B or C. The anchoring flanges 20, 22 may each present a generally flat surface to abut the surfaces B, C, as is shown in FIG. 5.

As illustrated in FIG. 5, the first base member 12 may also include a first mating portion 24 and the second base member 14 may also include a second mating portion 26. The mating portions 24, 26 are operable to mate and/or otherwise couple with the covering member 16 to secure the covering member 16 over and/or across the gap A. In some embodiments, as shown in FIG. 5, each mating portion 24, 26 may include a socket 28, 30, respectively, to receive a portion of the covering member 16. The sockets 28, 30 may be ball sockets to facilitate movement of the covering member 16 due to expansion and contraction of the surfaces B, C. However, the sockets 28, 30 may present any mating configuration operable to retain at least a portion of the covering member 16.

In some embodiments, the base members 12, 14 may each comprise a plurality of components. In one such embodiment, the base members 12, 14 each include a lower component for coupling with one of the surfaces B, C. The covering member 16 may rest atop the lower components to at least partially span the gap A. Each base member 12, 14 may additionally include an upper component operable to attach to the corresponding lower component. The upper and lower components of the base members 12, 14, may thus form receivers for the covering member 16. The upper and lower components may be discrete from each other such that the base members 12, 14 are not necessarily integrally formed.

In some embodiments, as shown in FIGS. 6-7, each mating portion 24, 26 may present one or more grooves 32, 34, respectively, to receive a portion of the covering member 16. As is discussed in more detail below, the grooves 32, 34 enable the base members 12, 14 and covering member 16 to be friction fitted to generally seal the covering member 16 to the base members 12, 14. However, the grooves 32, 34 may be configured to secure the covering member 16 to the base members 12, 14 without forming a seal therebetween.

Figure 10:
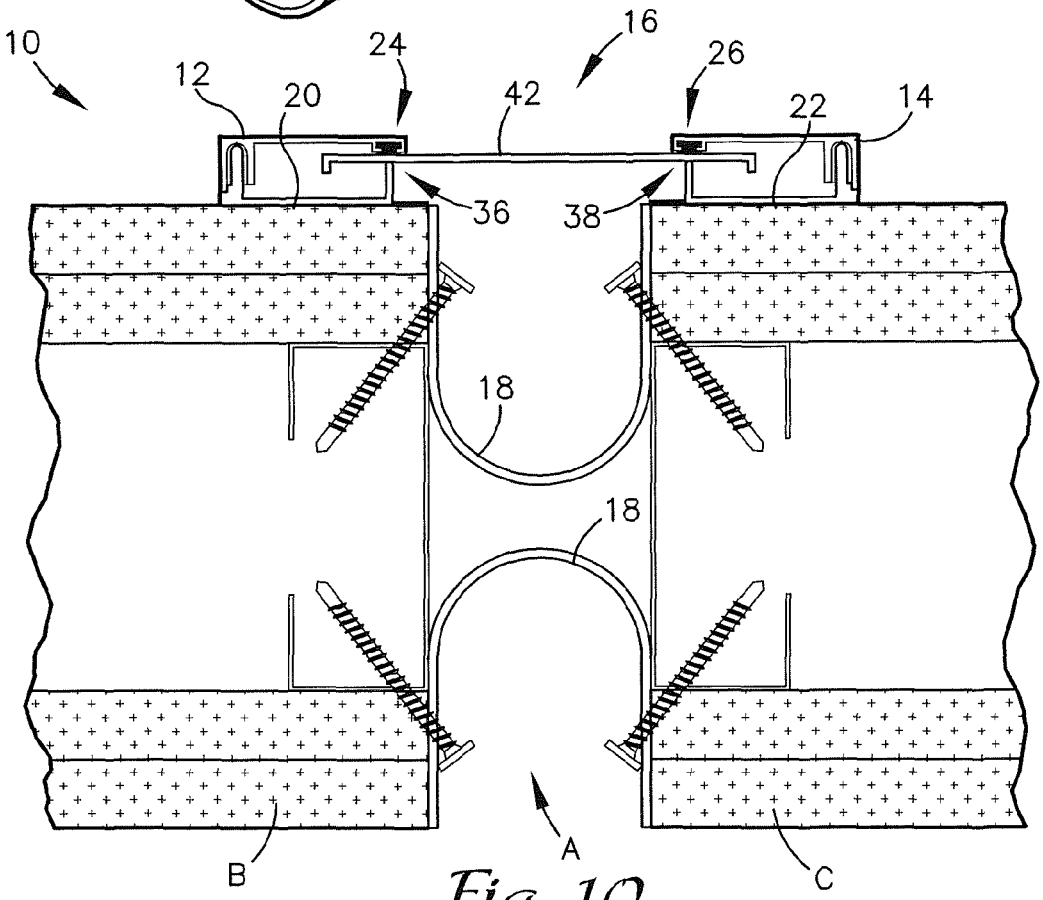
FIG. 10 is a side view of a joint cover system configured in accordance with various other embodiments of the present invention.
Figure 11:
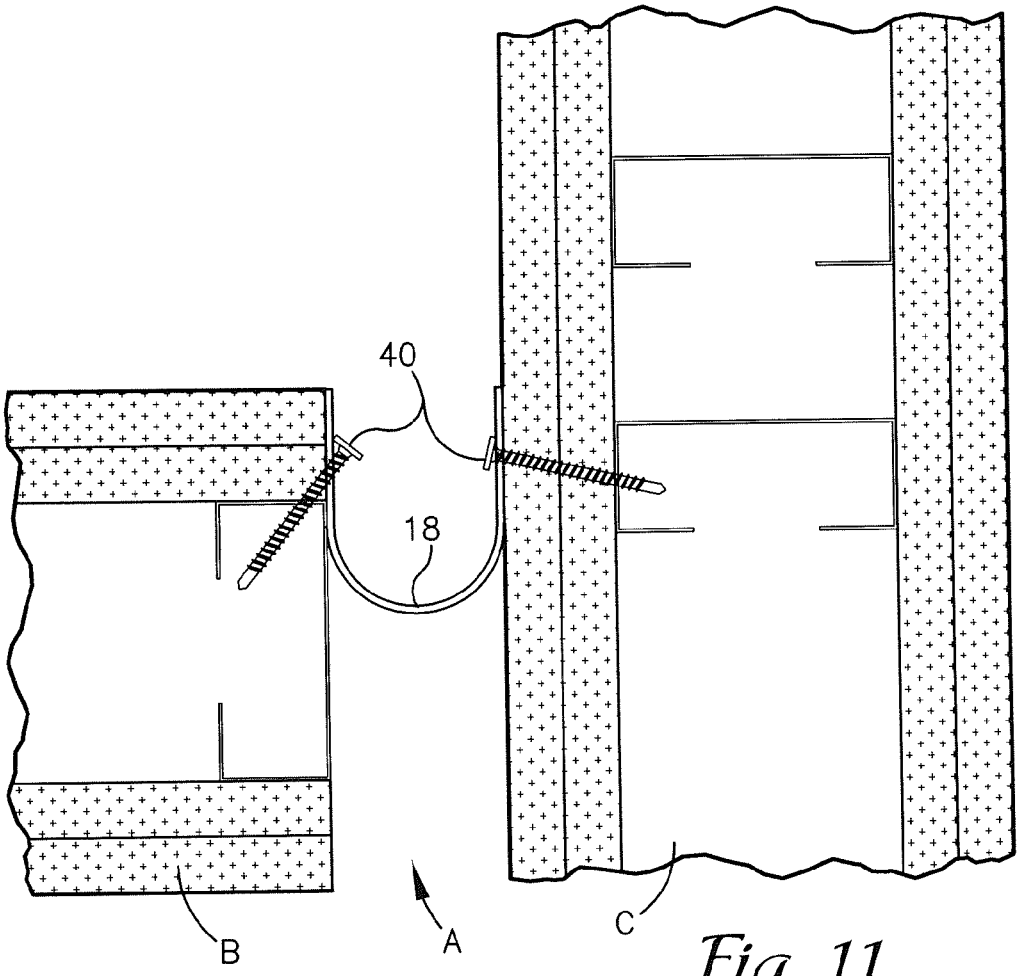
FIG. 11 is a side view showing an intumescent sheet coupled with two surfaces.
Figure 12:
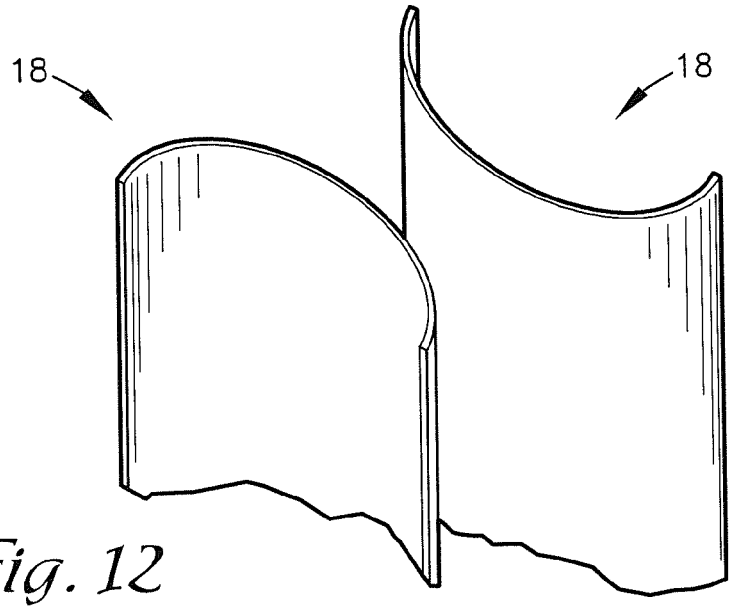
FIG. 12 is a perspective view of various intumescent sheets operable to be employed by various embodiments of the present invention.
Figure 13:
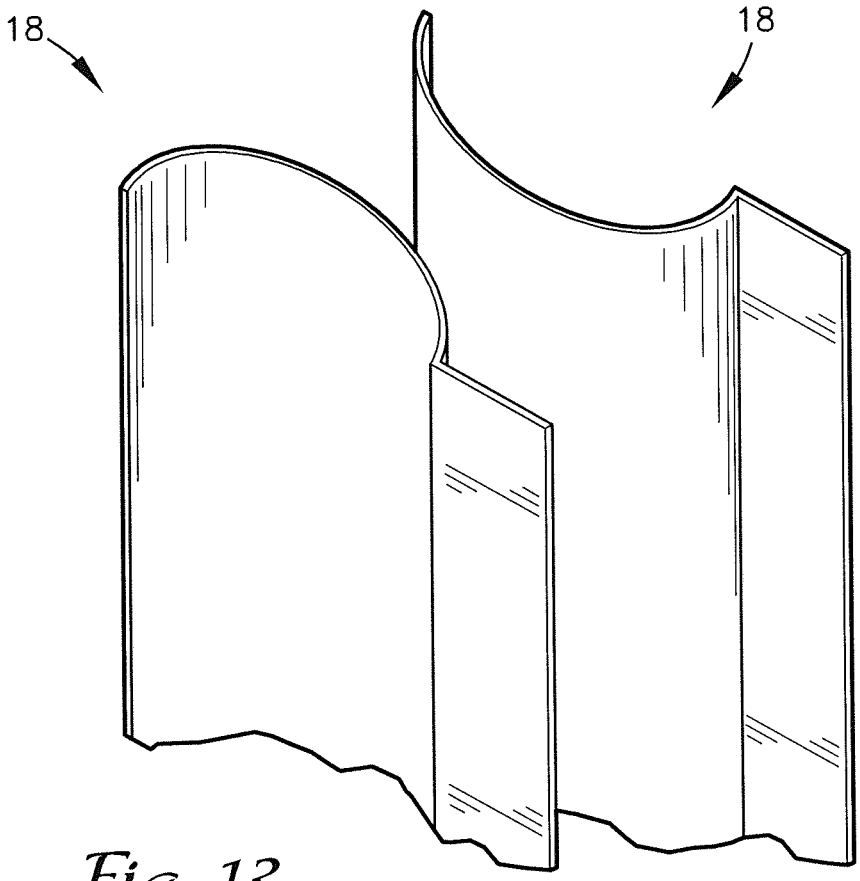
FIG. 13 is a perspective view of another intumescent sheet operable to be employed by various embodiments of the present invention.
Figure 14:
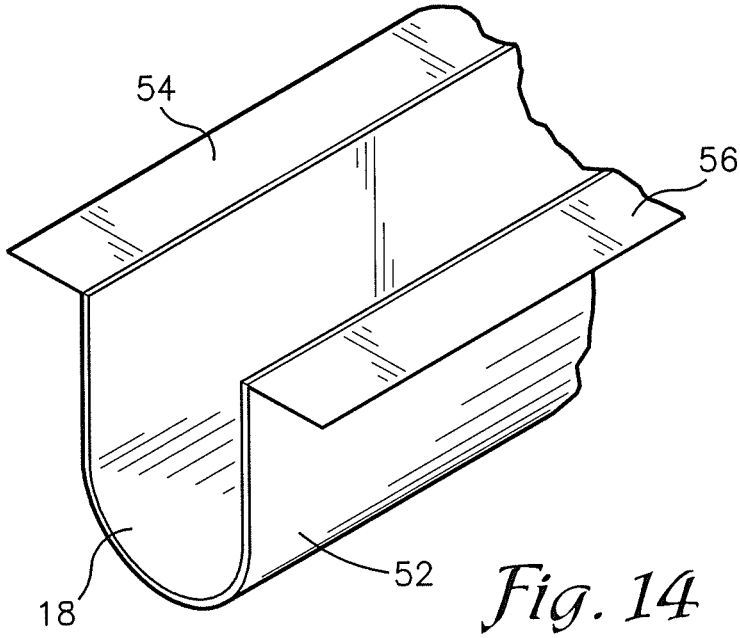
FIG. 14 is a perspective view of another intumescent sheet operable to be employed by various embodiments of the present invention.

In some embodiments, as shown in FIG. 10, each mating portion 24, 26 may present one or more slots 36, 38, respectively, to receive a portion of the covering member 16. As is discussed in more detail below, the slots 36, 38 enable the covering member 16 to be easily coupled with the base members 12, 14 to span the gap A between the surfaces B, C. The slots 36, 38 are preferably configured to enable the covering member 16 to be substantially received within each base member 12, 14 to prevent the covering member 16 from inadvertently decoupling therefrom. The slots 36, 38 may each include guides, stops, or other elements to facilitate reception and retention of the covering member 16.

The mating portions 24, 26 may additionally or alternatively include any conventional mating elements to mate with the covering member 16. Thus, the mating portions 24, 26 may include male and female connectors, removable and permanent fasteners, adhesive elements, magnetic elements, combinations thereof, and the like. Further, the mating portions 24, 26 are not necessarily similarly configured. For example, in some embodiments the first mating portion 24 may include the socket 28 while the second mating portion 26 may include a different mating element, such as the groove 34, the slot 38, combinations thereof, and the like. Such configurations may be desirable in embodiments where one of the base members 12, 14 is coupled to the top of one of the surfaces B or C and the other base member 12, 14 is coupled to the sides or bottom of the other surface B or C.

The base members 12, 14 are preferably comprised of a substantially rigid material such as metals, metal alloys, plastics, and the like, to facilitate support of the covering member 16 and other system 10 elements. In some embodiments, the base members 12, 14 are preferably comprised of extruded aluminum.

The system 10 may additionally include one or more anchors 40 to facilitate coupling of the base members 12, 14 and the surfaces B, C. In some embodiments, the anchors 40 are operable to couple both the base members 12, 14 and the intumescent sheet 18 with the surfaces B, C. The anchors 40 may comprise anchoring elements such as nails, staples, screws, rivets, bolts, pins, and/or any other fastening and anchoring elements. Preferably, the anchors 40 include a sharp tip to enable puncturing of the base members 12, 14, including the anchoring flanges 20, 22, and/or the intumescent sheet 18. However, in some embodiments the base members 12, 14 and/or intumescent sheet 18 may include apertures and/or perforations for receiving the anchors 40 such that the anchors 40 need not be operable for puncturing.

The covering member 16 may include any element or combination of elements operable to at least partially span the gap A between the surfaces B, C. The covering member 16 and the base members 12, 14 may each be formed from bronze, aluminum, steel, stainless steel, galvanized steel, and the like to present any desired appearance. In some embodiments, the covering member 16 presents a substantially flat profile and mechanically couples with the base members 12, 14 utilizing fastening elements such as nails, screws, bolts, pins, rivets, adhesives, combinations thereof, and the like.

In various embodiments, as shown in FIG. 5, the covering member 16 is configured as a floating covering member to enable joint movement due to expansion or contraction of the surfaces B, C. Thus, even if the surfaces B, C shift relative to each other, the covering member 16 may retain its position and remain covering the gap A between the surfaces B, C.

In some embodiments, the covering member 16 may include a covering plate 42. As shown in FIG. 5, the covering plate 42 may present a generally flat profile to facilitate a uniform transition between the surfaces B, C. The covering plate 42 may be formed from the various metals and materials discussed above. Further, in some embodiments the covering plate 42 may be covered with additional materials, such as carpet, fabric, tiles, woods, combinations thereof, and the like, to match surrounding surface coverings. The covering plate 42 may be formed of twenty gauge galvanized steel to present a rigid and durable surface.

As shown in FIG. 10, the covering plate 42 may be configured to couple with the base members 12, 14 through positioning within the slots 36, 38. For example, the generally-flat covering plate 42 may be slid within the slots 36, 38 to span the gap A between the surfaces B, C. The covering plate 42 may include protrusions at its ends to prevent the covering plate 42 from being inadvertently detached from the base members 12, 14.

In some embodiments, the covering member 16 may include a centering bar 44 operable to couple with the covering plate 42. The centering bar 44 is operable to couple with the covering plate 42 and the base members 12, 14 to enable the floating configuration discussed above. The centering bar 44 is preferably an elongated bar operable to span the gap A between the base members 12, 14 when the base members 12, 14 are coupled to the surfaces B, C. In some embodiments, the centering bar 44 may include opposed mating balls 46 to couple with the sockets 28, 30 provided by the base members 12, 14. The mating balls 46 may be fully spherical or partially spherical, such as where each mating ball 46 presents only a half-sphere for coupling with the base members 12, 14.

However, the centering bar 44 may additionally or alternatively present any mating connectors for reception by the mating portions 24, 26 of the base members 12, 14, such as mating pins, tabs, screws, nails, bolts, staples, conventional interlocking and fastening elements, combinations thereof, and the like. In some embodiments, the centering bar 44 may lack mating connectors.

The center of the covering plate 42 is preferably fixedly coupled to the center of the centering bar 44 to facilitate proper orientation and alignment of the covering plate 42. As shown in FIG. 5, the covering plate 42 may be coupled with the centering bar 44 utilizing a fastener such as a screw, nail, bolt, staple, pin, combinations thereof, and the like. The covering plate 42 may additionally be coupled to the centering bar 44 at more than one location along the length of the centering bar 44 or be directly and/or independently coupled to the base members 12, 14 without using the centering bar 44.

In various embodiments, as shown in FIGS. 6-7, the covering member 16 may be configured as a generally flexible elastomer seal element 48. The seal element 48 is generally operable to seal to the base members 12, 14 and generally withstand movement of the surfaces B, C. The seal element 48 may comprise flexible elastomers, such as rubber, Santoprene, EPDM, PCV, Neoprene, Hypalon, combinations thereof, and the like. However, the seal element 48 may comprise any element or combination of elements operable to couple with the base members 12, 14. Further, in some embodiments the seal element 48 does not necessarily seal with the base members 12, 14 as the seal element 48 may be configured to only securely attach to the base members 12, 14.

In some embodiments, the seal element 48 may include a plurality of tabs 50 operable to be friction fitted within the grooves 32, 34. Each tab 50 may present an arrow-like configuration where each tab 50 includes a head portion having a width greater than the width of one of the grooves 32, 34. The head portion may be sloped such that the tab 50 may be forced into one of the grooves 32, 34 with a limited amount of force while removal of the tab 50 requires much greater force due to the shape of the head portion. In some embodiments, the seal element 48 may include a plurality of tabs 50 along its ends to facilitate coupling with the grooves 32, 34. In other embodiments, the seal element 48 may include only a single tab 50 for reception by one of the grooves 32, 34. Additionally or alternatively, the seal element 48 may be sealed and/or coupled with the base members 12, 14 utilizing adhesives such as glue.

In various embodiments, the system 10 may include other elements to facilitate covering of the gap A. For example, the system 10 may include springs, water and moisture barriers, foil covers, support paneling, and centering devices in addition to the centering bar 44 discussed above.

The system 10 includes the at least one intumescent sheet 18 to provide a fire barrier. The intumescent sheet 18 may include any intumescent material operable to expand and/or swell when exposed to heat. In various embodiments, the intumescent sheet 18 includes an intumescent material extruded onto a film such as wax paper, mineral wool, artificial fiber ribbons, polyethylene film, polypropylene film, polyurethane film, polyester film, combinations thereof, and the like. In some embodiments, the intumescent sheet 18 may be comprised of a C.sub.2-C.sub.8 alkyl diamine phosphate fire retardant, as disclosed in U.S. Pat. No. 6,207,085, which is incorporated herein by specific reference.

The intumescent sheet 18 is preferably configured to substantially extend across the gap A and couple with both base members 12, 14 and/or surfaces B, C. In some embodiments, as shown in FIG. 10, the intumescent sheet 18 may directly couple with the surfaces B, C utilizing various fastening elements such as nails, screws, bolts, staples, pins, rivets, combinations thereof, and the like. For example, the intumescent sheet 18 may be attached to each surface B, C by puncturing the intumescent sheet 18 with a nail at each end and driving the nails into the surfaces B, C.

In some embodiments, as shown in FIGS. 1 and 7, portions of the intumescent sheet 18 may be positioned between the base members 12, 14 and the surfaces B, C to extend the intumescent 18 sheet over the gap A. In particular, portions of the intumescent sheet 18 may be sandwiched between the anchoring flanges 20, 22 and the surfaces B, C. In some embodiments, the anchoring flanges 20, 22 may be penetrated by the anchors 40 without penetrating the intumescent sheet 18. However, in other embodiments, it may be desirable to drive the anchors 40 through the anchoring flanges 20, 22 and intumescent sheet 18 and into the surfaces B, C to more securely retain the intumescent sheet 18.

In various embodiments, the intumescent sheet 18 is coupled with a support structure 52 that is operable to couple with the surfaces B, C and/or base members 12, 14 to enable the intumescent sheet 18 to be securely positioned without being punctured by the anchors 40. The support structure 52 may be formed of any material operable to couple with the intumescent sheet 18 and the base members 12, 14 and/or surfaces B, C.

The support structure 52 is preferably formed of a material operable to generally withstand heat such that the support structure 52 will resist failure under heat to enable the intumescent sheet 18 to appropriately expand and function as a fire barrier. In some embodiments, the support structure 52 may be formed of a foil sheet, a fiberglass scrim, and/or a high temperature fabric.

The support structure 52 is preferably larger in at least one dimension than the intumescent sheet 18. For example, in embodiments where the width of the support structure 52 is sufficient to span the gap A, as shown in FIGS. 1-4, the width of the intumescent sheet 18 is preferably less than the width of the support structure 52 such that the intumescent sheet 18 does not cover all portions of the support structure 52.

In various embodiments, the support structure 52 includes first and second opposed flanges 54, 56 operable to couple with the base members 12, 14 and/or surfaces B, C. The opposed flanges 54, 56 are preferably not covered by the intumescent sheet 18 to enable the opposed flanges 54, 56 to be punctured by the anchors 40 and secured to the surfaces B, C without affecting the integrity of the intumescent sheet 18. The opposed flanges 54, 56 may be directly affixed to the surfaces B, C using the anchors 40 or other fastening elements. In some embodiments, the flanges 54, 56 are configured to be placed between the anchoring flanges 20, 22 and the surfaces B, C. In such embodiments, the anchors 40 may be driven through the anchoring flanges 20, 22 and flanges 54, 56 and into the surfaces B, C to secure the support structure 52 and intumescent sheet 18 across the gap A without puncturing the intumescent sheet 18.

The intumescent sheet 18 may be coupled with the support structure 52 utilizing various fasteners such as nails, screws, bolts, rivets, pins, staples adhesives, combinations thereof, and the like. Preferably, the intumescent sheet 18 is attached to the support structure 52 such that the intumescent sheet 18 may not shift relative to the support structure 52. Such a configuration desirable increases the fire protection provided by the intumescent sheet 18 and support structure 52. In some embodiments, the intumescent sheet 18 may be fixedly attached to the support structure 52 utilizing fasteners positioned along the periphery of the intumescent sheet 18 in addition to or as an alternative to fasteners positioned only along the centerline of the intumescent sheet 18.

In various embodiments, as shown in FIGS. 1-4 and 10, the system 10 may include a plurality of intumescent sheets 18 with each sheet being coupled with the base members 12, 14 and/or surfaces B, C. Utilization of a plurality of intumescent sheets facilitates the formation of a fire barrier. In some embodiments, each of the intumescent sheets 18 may be positioned in the same orientation, as shown in FIG. 1, while in other embodiments the intumescent sheets 18 may be positioned in opposite orientations, as shown in FIG. 10. For example, in embodiments where the system 10 spans a gap between two wall elements, a first intumescent sheet may be orientated towards one face of the wall and a second intumescent sheet may be orientated towards the other face of the wall.

In embodiments including the plurality of intumescent sheets 18, each sheet 18 may be coupled with a support structure as discussed above. For example, as shown in FIGS. 1-4, the system 10 may include two intumescent sheets 18 each coupled with a support structure 52. In such embodiments, the flanges 54, 56 of each support structure 52 may each be directly affixed to the base members 12, 14 and/or surfaces B, C. However, the flanges 54, 56 of each support structure 52 are preferably sandwiched between the anchoring flanges 20, 22 and surfaces B, C to enable the anchors 40 to be driven through the anchoring flanges 20, 22 and the flanges 54, 56 and into the surfaces B, C. Thus, utilization of a plurality of support structures enables a plurality of intumescent sheets 18 to be positioned within the gap A without affecting the integrity of the sheets 18 even when the system 10 employs anchors 40 or other fastening elements.

Figure 4:
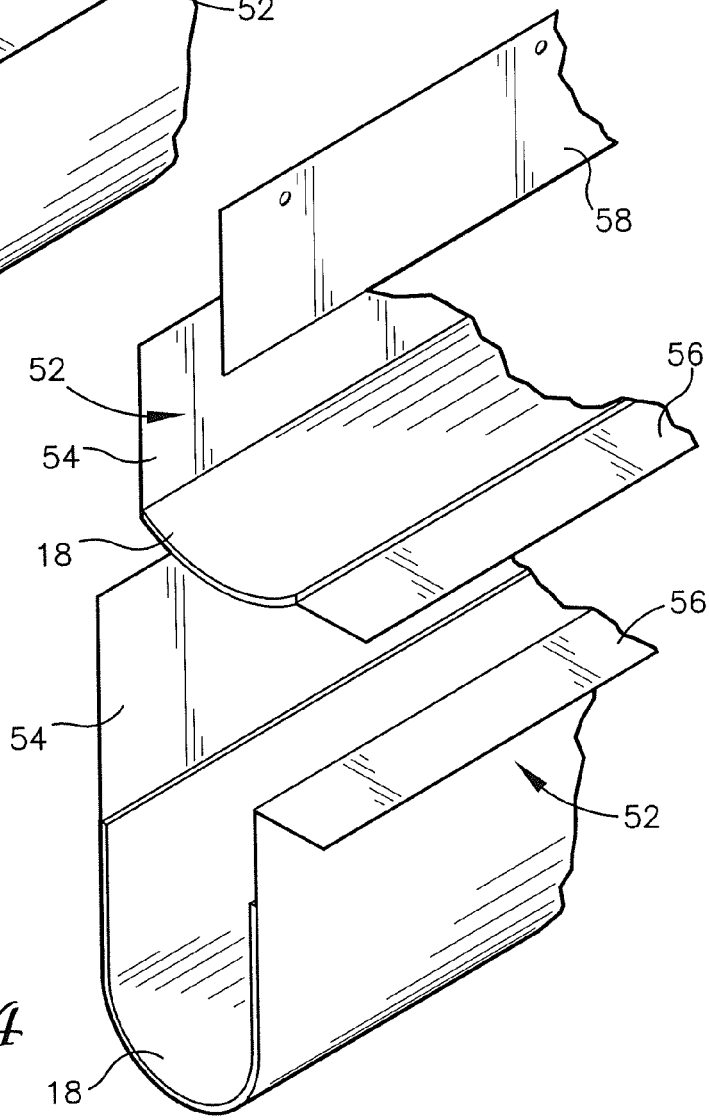
FIG. 4 is a perspective view of a center strip operable to couple with the intumescent sheets and support structures of FIG. 3.

In some embodiments, the system 10 may be configured without the use of the base members 12, 14. For example, the covering member 16 may be coupled with the surfaces B, C without the use of the base members 12, 14. In such embodiments, the one or more intumescent sheets 18 may be directly affixed to the surfaces B, C or sandwiched between the covering member 16 and the surfaces B, C and punctured with the anchors 40. In some embodiments, as shown in FIG. 4, the system 10 may include a center strip 58 to couple intumescent sheets 18 to the surfaces B, C without the use of the base members 12, 14 or covering member 16. For example, the intumescent sheets 18 may be attached to one of the surfaces B or C utilizing the covering member 16 and anchors 40 as discussed above and attached to the other surface B or C utilizing only the center strip 58, thereby allowing the covering member 16 to span the gap A independent of the intumescent sheets 18. The center strip 58 is preferably formed of metal, such as galvanized steel, or other resilient materials to enable the intumescent sheets 18 to be securely coupled to the surfaces B, C even when exposed to significant heat.

In operation, the base members 12, 14, covering member 16, and/or one or more intumescent sheets 18 may be coupled with the surfaces B, C as discussed above to cover the gap A and provide a fire barrier. In various embodiments, the system 10 may be installed in combination with other surface covering elements to present any desired appearance. For example, as shown in FIG. 5, the base members 12, 14 may be coupled with the surfaces B, C utilizing the anchors 40. The one or more intumescent sheets 18 may be coupled with the surfaces B, C by being sandwiched between the base members 12, 14 and the surfaces B, C or by being directly attached to the surfaces B, C utilizing the various fastening elements discussed above.

After installation of the base members 12, 14 and intumescent sheets 18, grout may be laid over the surfaces B, C and at least portions of the base members 12, 14, such as the anchoring flanges 20, 22. Carpet, tile, hardwood, shingles, or other surface covering elements may then be installed over the surfaces B, C and base members 12, 14. Before or after installation of the grout and surface covering elements, the covering member 16 may be coupled with the base members 12, 14 as discussed above, such as by coupling the centering bar 44 with the sockets 28, 30. The covering member 16 may also be covered with surface covering elements to aesthetically match its environment.

In some embodiments, the system 10 may be configured for installation in and/or over one or two inch nominal joints. Utilizing the base members 12, 14 and/or covering member 16 discussed above, the system 10 in some embodiments may provide for approximately seventy-five percent joint contraction and one-hundred percent joint expansion. Thus, in some embodiments the system 10 is operable to sufficiently cover joints having any widths between one-half of an inch and four inches. However, the system 10 may be employed to span gaps having any widths and configured to withstand expansion and contraction of any degree such that the system 10 is not limited to the particular examples given above.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A joint cover system operable to span a gap between two surfaces, each surface including a top face and a side face, the system comprising:

a first base member coupled with an uppermost portion of the top face of one of the surfaces, the first base member including a first leg;

a second base member coupled with an uppermost portion of the top face of the other surface, the second base member including a first leg;

a covering member monolithically formed with the base members to span the gap;

an intumescent sheet uninterruptedly spanning the entire gap between the first base member and the second base member; and a unitary support structure including an inner surface and an outer surface, with the inner surface directly coupled with the intumescent sheet and at least a portion of the outer surface in direct contact with the side face of both surfaces, wherein the first leg of the first base member and the first leg of the second base member each perpendicularly couple to the covering member to create space between the covering member and the gap.

2. The system of claim 1, wherein the support structure includes a foil sheet.

3. The system of claim 1, wherein the support structure includes a high-temperature fabric.

4. The system of claim 1, wherein the intumescent sheet is attached to the support structure with a fastener.

5. The system of claim 1, wherein the support structure further includes opposed flanges in direct contact with the uppermost portion of the top face of the surfaces.

6. The system of claim 5, wherein the intumescent sheet is not positioned on the flanges.

7. The system of claim 1, further including a second intumescent sheet and a second support structure coupled with the second intumescent sheet, the second support structure having opposed flanges operable to couple with the surfaces only along the opposed flanges and being larger in at least one dimension than the second intumescent sheet wherein the second intumescent sheet uninterruptedly spans the entire gap between the first base member and the second base member.

8. The system of claim 1, further including an anchor operable to penetrate the first base member and one of the flanges to couple the first base member and the support structure to one of the surfaces.

9. The system of claim 1, wherein the first base member and the second base member are constructed from extruded aluminum.

10. The system of claim 1, wherein the intumescent sheet is extruded onto polyethylene film and has a plurality of edges.

11. The system of claim 1, wherein the intumescent sheet comprises C.sub.2-C.sub.8 alkyl diamine phosphate fire retardant.

12. The system of claim 1, wherein the support structure further includes a scrim that couples with the intumescent sheet.

13. The system of claim 1, wherein the support structure is larger in at least one dimension than the intumescent sheet.

14. The joint cover system of claim 1, wherein the first base member and the second base member each include a second leg coupled to the first leg, parallel to the covering member, and through which a fastener couples the base member to the top face of one of the surfaces.

15. The joint cover system of claim 1, wherein the unitary support structure is provided with integral flanges which are affixed to the surfaces top face using the same anchor with which the base members are affixed to said surface.

16. A joint cover system operable to span a gap between two surfaces, each surface including a top face and a side face, the system comprising:

a first base member coupled with an uppermost portion of the top face of one of the surfaces, the first base member including a first leg;

a second base member coupled with an uppermost portion of the top face of the other surface, the second base member including a first leg;

a covering member monolithically formed with the base members to span the gap, wherein the first leg of the first base member and the first leg of the second base member each perpendicularly couple to the covering member to create space between the covering member and the gap;

an intumescent sheet uninterruptedly spanning the entire gap between the first base member and the second base member; and a unitary support structure including an inner surface and an outer surface, with the inner surface directly coupled with the intumescent sheet and at least a portion of the outer surface in direct contact with the side face of both surfaces, and a first flange coupled to a first edge of the support structure and a second flange coupled to an opposing second edge of the support structure with the first flange positioned between the first base member and the top face of one of the surfaces and the second flange positioned between the second base member and the top face of the other surface, wherein the support structure is operable to guide the expansion of the intumescent sheet toward the covering member during expansion of the intumescent sheet as a result of exposure to fire and to support the intumescent sheet once it has expanded.

17. A joint cover system operable to span a gap between two surfaces, each surface including a top face and a side face, the system comprising:

a first base member coupled with an uppermost portion of the top face of one of the surfaces, the first base member including a first leg;

a second base member coupled with an uppermost portion of the top face of the other surface, the second base member including a first leg;

a discrete covering member, monolithically formed to span the gap, engaged with and supported by the base members;

an intumescent sheet uninterruptedly spanning the entire gap between the first base member and the second base member; and a unitary support structure including an inner surface and an outer surface with the inner surface directly coupled with the intumescent sheet and at least a portion of the outer surface in direct contact with the side face of both surfaces, wherein the first leg of the first base member and the first leg of the second base member each perpendicularly couple to the covering member to create space between the covering member and the gap.

18. The joint cover system of claim 17, wherein the first base member and the second base member each include a second leg coupled to the first leg, parallel to the covering member, and through which a fastener couples the base member to the top face of one of the surfaces.

19. The joint cover system of claim 17, wherein the unitary support structure is provided with integral flanges which are affixed to the surfaces top face using the same anchor with which the base members are affixed to said surface.

* * * * *